US005836269A

United States Patent [19]

Schneider

[11] Patent Number: 5,836,269

[45] Date of Patent: Nov. 17, 1998

[54] COOLANT CIRCUIT OF AN INTERNAL-COMBUSTION ENGINE

[75] Inventor: Klaus Schneider, Tiefenbronn, Germany

[73] Assignee: Dr. Ing. h.c.F. Porsche AG, Weissach, Germany

[21] Appl. No.: 797,268

[22] Filed: Feb. 7, 1997

[30] Foreign Application Priority Data

Feb. 29, 1996 [DE] Germany ..... 196 07 638.2

[51] Int. Cl.[6] ..... F01P 7/14

[52] U.S. Cl. ..... 123/41.1; 123/41.54

[58] Field of Search ..... 123/41.1, 41.54

[56] References Cited

U.S. PATENT DOCUMENTS 3,820,593 6/1974 Pabst ..... 123/41.54

FOREIGN PATENT DOCUMENTS

0295445A2 12/1988 European Pat. Off. .
2722833 1/1996 France .
272244A1 1/1997 France .
3718697A1 12/1987 Germany .

OTHER PUBLICATIONS

Search Report, Jun. 1997, Europe.

*Primary Examiner*—Noah P. Kamen
*Attorney, Agent, or Firm*—Evenson, McKeown, Edwards & Lenahan, PLLC

[57] ABSTRACT

A coolant circuit contains an expansion tank to which at least one vent line is connected which is connected with an internal-combustion engine and/or a radiator. In order to shorten the warm-up phase of the internal-combustion engine, a stop valve is provided to block the connection of the vent line to the expansion tank during the warm-up phase. As a result, the coolant situated in the expansion tank is not circulated in the short circuit.

18 Claims, 2 Drawing Sheets

COOLANT CIRCUIT OF AN INTERNAL-COMBUSTION ENGINE

BACKGROUND AND SUMMARY OF THE INVENTION

This invention relates to a particularly constructed coolant circuit of an internal-combustion engine of the type having hollow coolant spaces in an engine casing, a coolant pump, and a thermostatic valve for switch over between a main circuit and a short circuit. The coolant circuit also includes a radiator, an expansion tank with a pressure control valve and at least one vent line leading into the expansion tank.

A coolant circuit of this type is described in German Patent Document DE 37 18 697 A1. In this overall coolant circuit, a main circuit and a short circuit are constructed. The main and short circuits are switched as a function of the operating temperature of the coolant by a thermostatic valve. The short circuit is switched below a given opening temperature of the thermostatic valve, that is, during a cold start and a warm-up phase of the internal-combustion engine. Only a portion of the coolant is circulated in this short circuit without flowing through the radiator in order to reduce the warm-up time. In addition, an expansion tank is provided in this coolant circuit. The expansion tank is used as a coolant reservoir and as an expansion reservoir for temperature-caused volume fluctuations of the coolant. At the same time, this expansion tank is used as an air or gas separator. Vent lines lead from high-lying points of the internal-combustion engine and/or of the radiator into this expansion tank for this purpose. The expansion tank is normally integrated into the circuit such that it carries out its storage, expansion and venting function independently of the operating temperature of the coolant and thus in the main circuit as well as in the short circuit. The coolant volume situated in the expansion tank must also be warmed up during both the cold start and the warm-up phase of the internal-combustion engine. The warm-up phase of the engine is therefore extended which leads to higher fuel consumption and pollution. In German Patent Document DE 37 18 697 A1, it is suggested that, to shorten the warm-up phase, the volume of the expansion tank should be divided such that at least two spaces are provided to store the coolant. Only the smaller storage space is integrated into the short circuit of the internal-combustion engine so that the significantly smaller volume is heated faster.

In contrast, it is an object of the invention to improve a coolant circuit of an internal-combustion engine such that the warm-up phase is reduced considerably and the coolant quantity circulated in the short circuit is significantly reduced.

According to the invention, this object is achieved by an arrangement wherein a stop valve is arranged in at least one vent line to selectively block a connection to the expansion tank. By arranging a stop valve in the vent line to selectively block the connection to the expansion tank in the warm-up phase, the coolant volume stored in the expansion tank can be largely uncoupled from the coolant circuit. As a result, this coolant does not have to be heated in the warm-up phase so that the warmup phase is shortened. If blockage of the vent line is opened up when a given operating medium temperature is reached or when other operating quantities depending on the operating medium temperature are reached, then the expansion tank with the stored coolant volume is integrated in a manner known per se into the short circuit or the overall circuit of the coolant.

According to the invention, blocking of the vent line advantageously takes place as a function of the operating temperature of the coolant and/or as a function of the pressure in the expansion tank. The pressure in the expansion tank is a function of the temperature-dependent volume change of the coolant. Consequently, a temperature-dependent blocking or opening of the vent line to the expansion tank also takes place indirectly.

A pressure-dependent or temperature-dependent connection and disconnection of the vent line advantageously takes place by arranging the stop valve on the expansion tank and adjusting its valve member by a piston acted upon by pressure in the expansion tank. In a particularly advantageous manner, the valve member itself can be constructed as a piston which can be acted upon by pressure.

If the valve member is constructed as a piston acted upon by pressure against the effect of a spring, then a definable adjustment of the opening point can take place in an advantageous manner. In this case, the opening pressure or the opening temperature may be within the range of the opening temperature of the thermostatic valve. However, an opening temperature or an opening pressure which causes the stop valve to open earlier than the thermostatic valve is also conceivable.

Several vent lines may be provided in such a coolant circuit and connected, for example, with the radiator of the coolant circuit (heat exchanger) and the casing of the internal-combustion engine. If this is the case, then the vent lines can advantageously be guided together on the stop valve. Both vent lines or all vent lines can then be blocked by the valve member and the constructional expenditures are reduced significantly.

Separately guiding different vent lines to the valve member in this case has the advantage of eliminating a coolant flow between the individual vent lines bypassing the expansion tank due to pressure differences resulting from different line lengths. When the vent lines are guided together in front of the valve member, different line pressure losses occur because of the different line lengths. This could result in forcing heated coolant from one vent line into the other and thus back into the circuit.

In order to provide improved servicing and a lower-cost repair to such a coolant circuit, it is advantageous for the stop valve to be detachably fastened to the expansion tank.

Furthermore, it is advantageous for the stop valve to be manually operable independently of the pressure in the expansion tank. As a result, for a first filling, a new filling or during servicing and repair, filling of the coolant circuit and the expansion tank can take place in a simple manner.

Other objects, advantages and novel features of the present invention will become apparent from the following detailed description of the invention when considered in conjunction with the accompanying drawings.

DETAILED DESCRIPTION OF THE DRAWINGS

Figure 1:
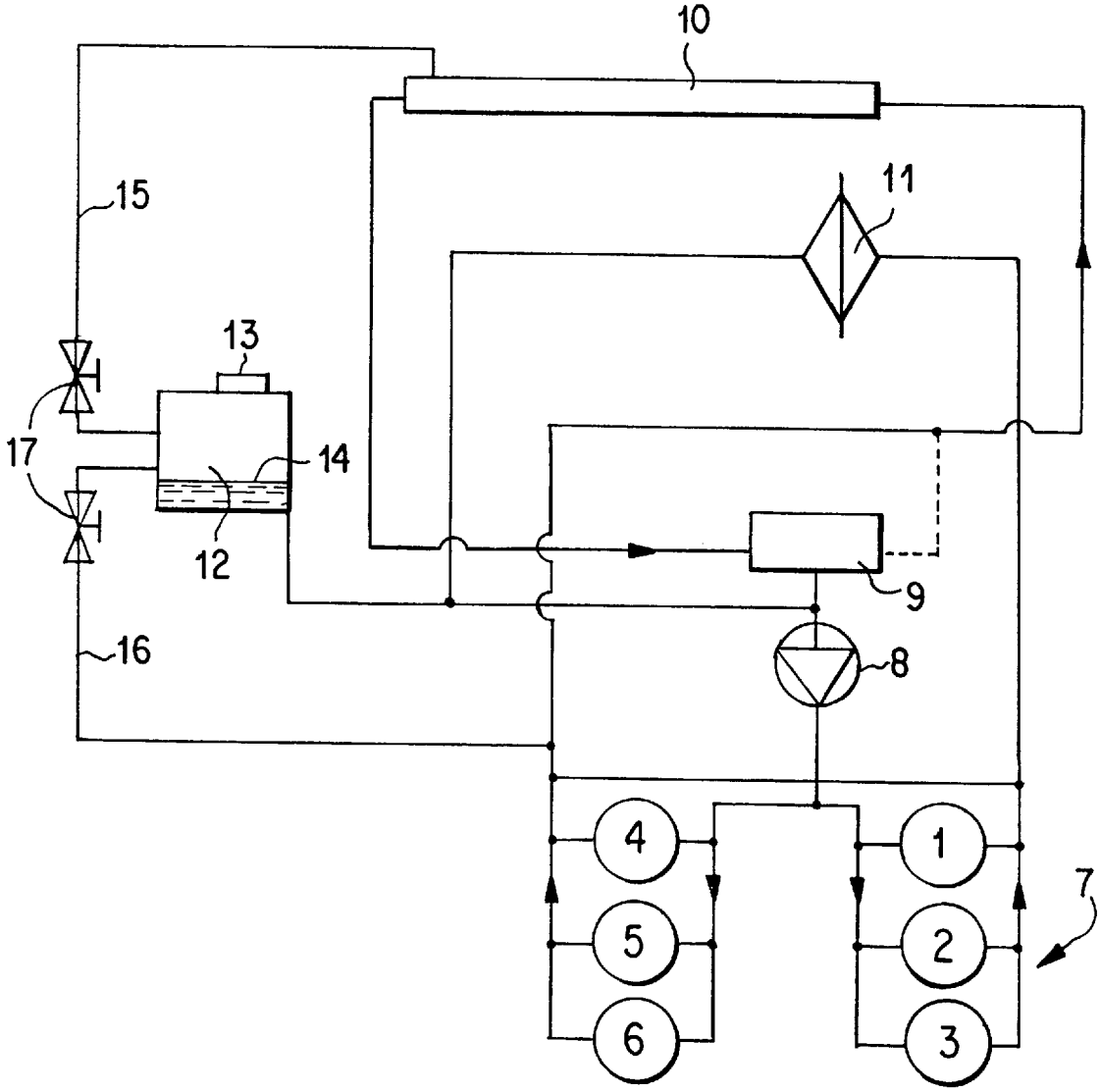
FIG. 1 is a schematic wiring diagram of the coolant circuit for an internal combustion engine constructed according to preferred embodiments of the invention.

Without any limitation to this embodiment, the coolant circuit according to the invention is schematically illustrated in FIG. 1 in connection with a double-bank internal-combustion engine with cylinders 1 to 6. The casing 7 of the internal-combustion engine, which is not shown in detail, has hollow spaces. These hollow spaces are arranged in the area of the cylinder block and the cylinder head which are also not shown in detail. During the operation of the internal-combustion engine, coolant flows through the cylinder block and the cylinder head. Circulation of the coolant is produced by a coolant pump 8 which, in this embodiment, is connected on the suction side with a known thermostatic valve 9. The thermostatic valve 9 opens up or blocks the connection between the coolant pump 8 and the casing 7 of the internal-combustion engine to a radiator 10 (heat exchanger) as a function of the operating temperature of the coolant. Below a given opening temperature of the thermostatic valve 9, the coolant pump 8 circulates the coolant in a short circuit. In this case, the flow takes place through the hollow spaces in the casing 7 of the internal-combustion engine and through a heater heat exchanger 11 without any simultaneous flow through the radiator 10. Thus, only a portion of the coolant is circulated and, during the flow through the radiator, cooling is avoided during the warm-up phase. When the operating temperature of the coolant exceeds the given opening temperature of the thermostatic valve 9, the connection of the coolant pump 8 to the radiator 10 is opened up so that all coolant circulates through the radiator 10 (main circuit).

In both circuits, the suction side of the coolant pump 8 is connected with an expansion tank 12 which is used as a reservoir and a buffer tank for the coolant. The expansion tank 12 is provided with a pressure control valve 13 which is known per se and which permits a connection to the environment as a function of the internal tank pressure. The gas situated above the coolant level 14 in the expansion tank 12 can therefore be relieved when a given maximum pressure is exceeded. Two vent lines 15 and 16 are connected with the expansion tank. The vent line 15 is connected with the radiator 10 of the internal-combustion engine and the vent line 16 leads to a high point of the casing 7 of the internal-combustion engine. Each of the connections of the vent lines 15 and 16 with the expansion tank 12 can be blocked by a stop valve 17.

Figure 2:
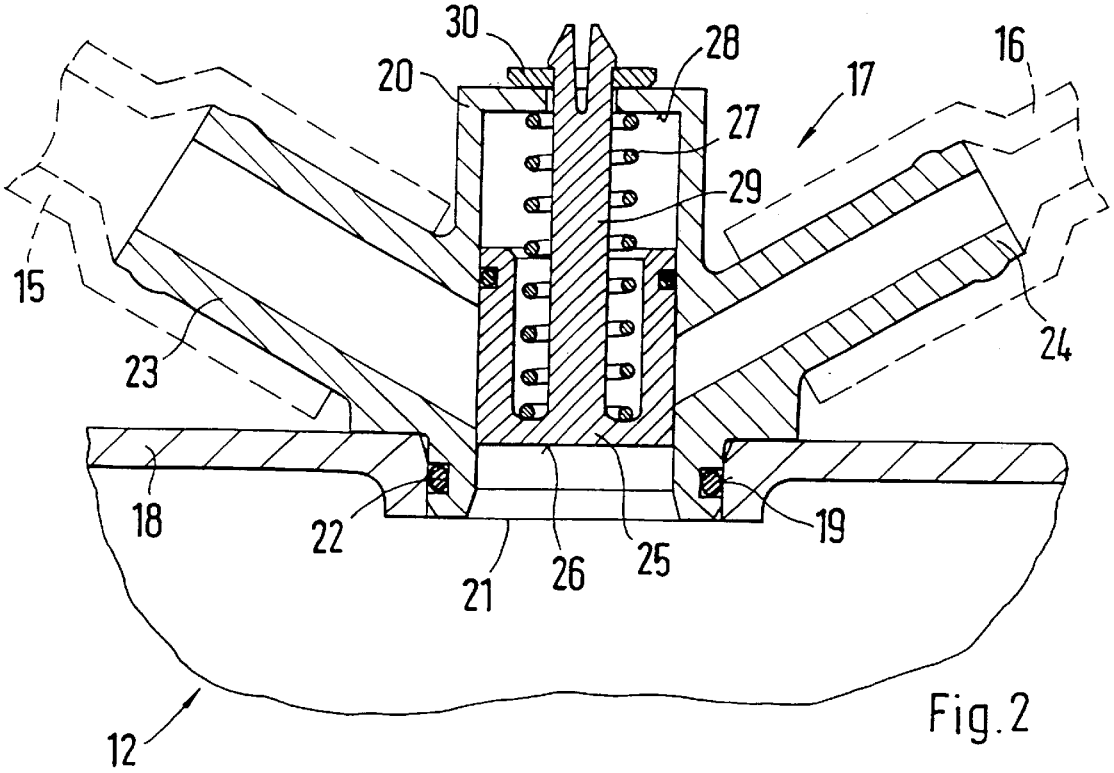
FIG. 2 is a sectional view of a stop valve according to the invention.

FIG. 2 shows an only partially illustrated housing 18 of the expansion tank 12. The top side of the expansion tank has an opening 19 into which the valve housing 20 of the stop valve 17 is inserted. The open underside of the cylindrical valve housing 20 of the stop valve 17 is inserted into the opening 19 of the housing 18 and is sealed off by a sealing ring 22. The stop valve 17 is releasably fastened to the expansion tank 12 by screwing the valve housing 20 into the opening 19, by a screwed connection to the housing 18 of the expansion tank 12, by additional screws, or by detent devices or similar fastening devices. Above the expansion tank 12, two vent connections 23, 24 lead into the interior of the valve housing 20. The vent connection 23 is connected with the vent line 15 and the vent connection 24 is connected with the vent line 16.

In the interior of the cylindrical valve housing 20, a piston-shaped valve member 25 is axially movably guided. A front side 26 of the valve member 25 is acted upon by the pressure p in the interior of the expansion tank 12. One end of a pressure spring 27 is supported on the opposite interior side of the valve member 25. The other end of the pressure spring 27 rests against a front side 28 of the valve housing 20. Furthermore, on the side facing away from the expansion tank 12, the valve member 25 has a pin 29 which is surrounded by the pressure spring 27 and penetrates the front side 28 of the valve housing 20. Outside the valve housing 20, this pin 29 is surrounded by a disk 30. In the end position of the valve member 25 illustrated in FIG. 2, the disk 30 rests as an end stop against the exterior side of the valve housing 20. In the switching position of the stop valve 17 illustrated in FIG. 2, the valve member 25 is in its low end position or the closing position. In this switching position, the two vent connections 23 and 24 are closed on one side by the valve member 25. No connection exists between the vent lines 15, 16 and the expansion tank 12. Because of the temperature-dependent volume increase of the coolant, the internal pressure in the expansion tank 12 will exceed an opening pressure predetermined by the prestressing of the pressure spring 27. If this is the case, then the valve member 25 is lifted against the effect of the pressure spring 27 so that the connection of the vent connections 23 and 24, and thus of the vent lines 15 and 16, to the expansion tank 12 is opened up.

During a cold start of the internal-combustion engine, the coolant level/ coolant volume in the expansion tank is low and the internal tank pressure corresponds to the ambient pressure. When the volume of the coolant increases as the engine is warming-up, the coolant level in the expansion tank, and thus its internal pressure, will rise. When the internal pressure exceeds a predetermined maximal pressure, the pressure control valve will open up to the environment and the gas situated in the expansion tank can escape so that the pressure falls. The pressure difference between the internal tank pressure and the ambient pressure affects the valve member or the piston which is also acted upon by the spring. When a predetermined opening pressure is exceeded, the valve member is displaced and the vent connections are opened up. The pressure spring is designed such that its prestress is just enough to move the valve member back against the friction of the seal into its starting position as the coolant cools. However, it is also possible to provide a higher opening force and thus a higher opening temperature and/or opening pressure by a corresponding spring element design.

Figure 3:
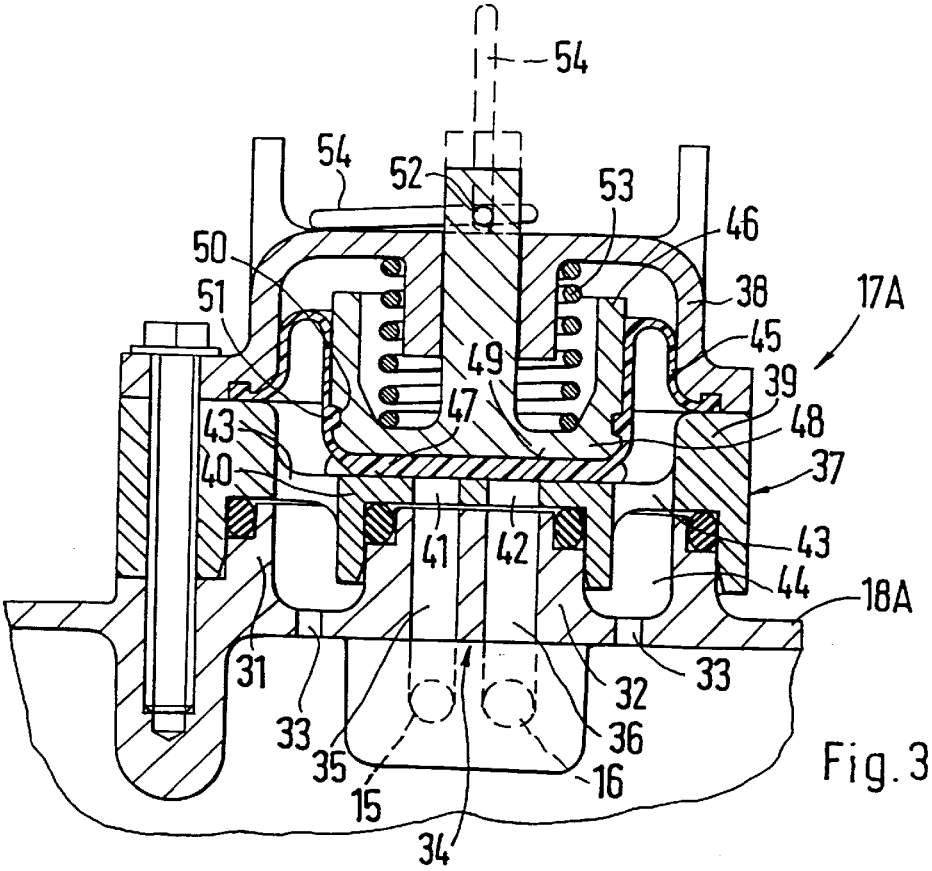
FIG. 3 is a sectional view of a second embodiment of the stop valve.

In the second embodiment of the stop valve 17A illustrated in FIG. 3, the housing 18A of the expansion tank 12 has two concentrically surrounding, ring-shaped webs 31, 32 on its exterior side. Between the exterior web 31 and the interior web 32, the housing 18A is penetrated by several openings 33 which are connected with the interior of the expansion tank 12. A connection using a single opening is also conceivable. Two separate ducts 35, 36 extend in the tank section 34 which is bounded by the interior ring-shaped web 32. These ducts 35, 36 are guided, in a manner not shown in detail and indicated only by a broken line, in a sealed-off manner to the exterior side of the housing 18A. The ducts are connected there with the vent lines 15 and 16. A valve housing bottom part 37 is covered by a valve housing top part 38 and is placed on the two concentric webs 31 and 32.

The valve housing bottom part 37 consists of an exterior ring 39 which reaches over and surrounds the exterior web 31 of the housing 18A and is screwed together with the web. An interior ring 40 is connected with this ring 39. The interior ring 40 reaches over and surrounds the interior ring-shaped web 32. The ring 40 has two through-openings 41, 42 which are connected with the ducts 35 and 36 of the housing 18A. Between the two rings 39 and 40, the valve housing bottom part 37 has several passages 43. These passages are connected with the annulus 44 between the interior and the exterior webs 31, 32 of the housing 18A. Here also, the connection by way of a single passage is conceivable.

Between the valve housing top part 38 and the valve housing bottom part 37, a roller membrane 45 is clamped. Under the effect of a spring-loaded piston 46, the roller membrane rests on the front surface 47 of the interior ring 40. This front surface 47 is constructed as a sealing surface and thus, on one side, closes off the openings 41, 42 and therefore the ducts 35, 36. For this purpose, the cup-shaped piston 45 rests with its bottom 48 against the interior side 49 of the roller membrane 45 and has a ring groove 50 which extends around on the circumference side and into which a surrounding ring 51 of the roller membrane 45 engages. The piston also has a pin 52 which is guided in the valve top part 38 and penetrates it. A pressure spring 53 reaches around the pin 52 and is supported on one side on the bottom 48 of the piston 46 and, on the other side, on the valve housing top part 38.

In this embodiment, the internal pressure of the expansion tank does not act upon the piston. The internal pressure instead acts, by way of the openings 33, the annulus 44 and the passages 43, upon the exterior area of the roller membrane 45, while the interior area of the roller membrane closes off and opens up the vent connections 41, 42; 35, 36.

A swivellable bow element 54 is fastened to the pin 52 outside the valve housing top part 38. The piston 46 and therefore the roller membrane 45 can be manually lifted by this bow element 54 independently of the pressure in the expansion tank 12. The bow element 54 has two swivel positions (shown by a solid line and by a broken line). In the swivel position indicated by the broken line, the piston 46 is held in a position in which the stop valve is opened up.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Coolant circuit of an internal-combustion engine comprising:

hollow spaces in a casing of this internal-combustion engine through which a coolant flows, a coolant pump for pumping coolant through the hollow spaces, a main coolant circuit and a short coolant circuit, a thermostatic valve for switch-over between the main coolant circuit and the short circuit, a radiator disposed in the main coolant circuit, an expansion tank having a pressure control valve, and at least one vent line leading into the expansion tank, wherein a stop valve is arranged in the at least one vent line for selectively blocking a connection to the expansion tank in both flow directions of coolant flow through said connection and the stop valve is in communication with coolant in the expansion tank and operated by pressure changes resulting from variations in the operating temperature of the coolant.

2. Coolant circuit of an internal-combustion engine according to claim 1, wherein the stop valve interacts with at least two vent lines, of which one is connected with the radiator and the other is connected with one of the hollow spaces in the casing of the internal-combustion engine.

3. Coolant circuit of an internal-combustion engine according to claim 1, comprising a fastener releasably fastening the stop valve to the expansion tank.

4. Coolant circuit of an internal-combustion engine according to claim 1, wherein the stop valve has a valve member, and comprising a manual operating member for manually operating the valve member independently of the pressure in the expansion tank.

5. Coolant circuit of an internal-combustion engine comprising:

hollow spaces in a casing of this internal-combustion engine through which a coolant flows, a coolant pump for pumping coolant through the hollow spaces, a main coolant circuit and a short coolant circuit, a thermostatic valve for switch-over between the main coolant circuit and the short circuit, a radiator disposed in the main coolant circuit, an expansion tank having a pressure control valve, and at least one vent line leading into the expansion tank, wherein a stop valve is arranged in the at least one vent line for selectively blocking a connection to the expansion tank in both flow directions of coolant flow through said connection, the stop valve is arranged on the expansion tank and has a valve member which is operated by an actuating unit which is acted upon by pressure in the expansion tank, and the valve member is connected with a membrane which is acted upon by pressure.

6. Coolant circuit of an internal-combustion engine according to claim 5, wherein the stop valve includes a spring, and wherein the valve member is acted upon by pressure in the expansion tank against the effect of the spring.

7. Coolant circuit of an internal-combustion engine according to claim 5, wherein the valve member interacts with at least two vent lines, of which one is connected with the radiator and the other is connected with one of the hollow spaces in the casing of the internal-combustion engine.

8. Coolant circuit of an internal-combustion engine according to claim 5, comprising a fastener releasably fastening the stop valve to the expansion tank.

9. Coolant circuit of an internal-combustion engine comprising:

hollow spaces in a casing of this internal-combustion engine through which a coolant flows, a coolant pump for pumping coolant through the hollow spaces, a main coolant circuit and a short coolant circuit, a thermostatic valve for switch-over between the main coolant circuit and the short circuit, a radiator disposed in the main coolant circuit, an expansion tank having a pressure control valve, and at least one vent line leading into the expansion tank, wherein a stop valve is arranged in the at least one vent line for selectively blocking a connection to the expansion tank in both flow directions of coolant flow through said connection, the stop valve has a valve member, and the valve member interacts with at least two vent lines, of which one is connected with the radiator and the other is connected with one of the hollow spaces in the casing of the internal-combustion engine.

10. Coolant circuit of an internal-combustion engine according to claim 9, comprising a fastener releasably fastening the stop valve to the expansion tank.

11. Coolant circuit of an internal-combustion engine comprising:

hollow spaces in a casing of this internal-combustion engine through which a coolant flows, a coolant pump for pumping coolant through the hollow spaces, a main coolant circuit and a short coolant circuit, a thermostatic valve for switch-over between the main coolant circuit and the short circuit, a radiator disposed in the main coolant circuit, an expansion tank having a pressure control valve, and at least one vent line leading into the expansion tank, wherein a stop valve is arranged in the at least one vent line for selectively blocking a connection to the expansion tank in both flow directions of coolant flow through said connection, the stop valve has a valve member, and comprising a manual operating member for manually operating the valve member independently of the pressure in the expansion tank.

12. Coolant circuit of an internal-combustion engine according to claim 11, wherein the valve has a valve housing, and wherein the valve member has a pin which penetrates the valve housing and is accessible from the outside.

13. Coolant circuit of an internal-combustion engine comprising:

hollow spaces in a casing of this internal-combustion engine through which a coolant flows, a coolant pump for pumping coolant through the hollow spaces, a main coolant circuit and a short coolant circuit, a thermostatic valve for switch-over between the main coolant circuit and the short circuit, a radiator disposed in the main coolant circuit, an expansion tank having a pressure control valve, and at least one vent line leading into the expansion tank, wherein a stop valve is arranged in the at least one vent line for selectively blocking a connection to the expansion tank in both flow directions of coolant flow through said connection, the stop valve is in communication with coolant in the expansion tank and operated by pressure changes in the expansion tank, and the stop valve interacts with at least two vent lines, of which one is connected with the radiator and the other is connected with one of the hollow spaces in the casing of the internal-combustion engine.

14. Coolant circuit of an internal-combustion engine comprising:

hollow spaces in a casing of this internal-combustion engine through which a coolant flows, a coolant pump for pumping coolant through the hollow spaces, a main coolant circuit and a short coolant circuit, a thermostatic valve for switch-over between the main coolant circuit and the short circuit, a radiator disposed in the main coolant circuit, an expansion tank having a pressure control valve, and at least one vent line leading into the expansion tank, wherein a stop valve is arranged in the at least one vent line for selectively blocking a connection to the expansion tank in both flow directions of coolant flow through said connection, the stop valve is arranged on the expansion tank and has a valve member which is operated by an actuating unit which is acted upon by pressure in the expansion tank, and the valve member interacts with at least two vent lines of which one is connected with the radiator and the other is connected with one of the hollow spaces in the casing of the internal-combustion engine.

15. Coolant circuit of an internal-combustion engine comprising:

hollow spaces in a casing of this internal-combustion engine through which a coolant flows, a coolant pump for pumping coolant through the hollow spaces, a main coolant circuit and a short coolant circuit, a thermostatic valve for switch-over between the main coolant circuit and the short circuit, a radiator disposed in the main coolant circuit, an expansion tank having a pressure control valve, and at least one vent line leading into the expansion tank, wherein a stop valve is arranged in the at least one vent line for selectively blocking a connection to the expansion tank in both flow directions of coolant flow through said connection, the stop valve is arranged on the expansion tank and has a valve member which is operated by an actuating unit which is acted upon by pressure in the expansion tank, the valve member is constructed as a position which can be acted upon by pressure, and the valve member interacts with at least two vent lines, of which one is connected with the radiator and the other is connected with one of the hollow spaces in the casing of the internal-combustion engine.

16. Coolant circuit of an internal-combustion engine comprising:

hollow spaces in a casing of this internal-combustion engine through which a coolant flows, a coolant pump for pumping coolant through the hollow spaces, a main coolant circuit and a short coolant circuit, a thermostatic valve for switch-over between the main coolant circuit and the short circuit, a radiator disposed in the main coolant circuit, an expansion tank having a pressure control valve, and at least one vent line leading into the expansion tank, wherein a stop valve is arranged in the at least one vent line for selectively blocking a connection to the expansion tank in both flow directions of coolant flow through said connection, the stop valve is arranged on the expansion tank and has a valve member which is operated by an actuating unit which is acted upon by pressure in the expansion tank, the stop valve comprises a spring, the valve member is acted upon by pressure in the expansion tank against the effect of the spring, and the valve member interacts with at least two vent lines, of which one is connected with the radiator and the other is connected with one of the hollow spaces in the casing of the internal-combustion engine.

17. Coolant circuit of an internal-combustion engine comprising:

hollow spaces in a casing of this internal-combustion engine through which a coolant flows, a coolant pump for pumping coolant through the hollow spaces, a main coolant circuit and a short coolant circuit, a thermostatic valve for switch-over between the main coolant circuit and the short circuit, a radiator disposed in the main coolant circuit, an expansion tank having a pressure control valve, and at least one vent line leading into the expansion tank, wherein a stop valve is arranged in the at least one vent line for selectively blocking a connection to the expansion tank in both flow directions of coolant flow through said connection, the stop valve is in communication with coolant in the expansion tank and operated by pressure changes in the expansion tank, and the stop valve has a valve member, and comprising a manual operating member for manually operating the valve member independently of the pressure in the expansion tank.

18. Coolant circuit of an internal-combustion engine comprising:

hollow spaces in a casing of this internal-combustion engine through which a coolant flows, a coolant pump for pumping coolant through the hollow spaces, a main coolant circuit and a short coolant circuit, a thermostatic valve for switch-over between the main coolant circuit and the short circuit, a radiator disposed in the main coolant circuit, an expansion tank having a pressure control valve, and at least one vent line leading into the expansion tank, wherein a stop valve is arranged in the at least one vent line for selectively blocking a connection to the expansion tank in both flow directions of coolant flow through said connection, the stop valve is in communication with coolant in the expansion tank and operated by pressure changes in the expansion tank, and the stop valve has a housing and a pin which penetrates the valve housing and is accessible from the outside.

* * * * *